US007316638B1

(12) United States Patent
Fabela

(10) Patent No.: US 7,316,638 B1
(45) Date of Patent: Jan. 8, 2008

(54) COMBINATION STACK WEIGHT SELECTOR AND ADD-ON ASSEMBLY

(76) Inventor: Juaquin T. Fabela, 4340 Midas Ave., Rocklin, CA (US) 95677

( * ) Notice: Subject to any disclaimer, the term of this patent is extended or adjusted under 35 U.S.C. 154(b) by 688 days.

(21) Appl. No.: 10/788,853

(22) Filed: Mar. 1, 2004

(51) Int. Cl.
*A63B 21/00* (2006.01)

(52) U.S. Cl. ..... 482/187; 482/99; 482/93; 482/94

(58) Field of Classification Search ..... 482/91, 482/92–104, 105–10, 81–83, 49, 107
See application file for complete search history.

(56) References Cited

U.S. PATENT DOCUMENTS 2,470,815 A * 5/1949 Harvey ..... 482/106
4,819,935 A * 4/1989 Dirksing et al. ..... 482/109
5,135,453 A * 8/1992 Sollenberger ..... 482/101
5,556,362 A * 9/1996 Whipps ..... 482/98
5,628,716 A * 5/1997 Brice ..... 482/106
5,853,355 A * 12/1998 Standish ..... 482/106
D456,865 S * 5/2002 Caporali et al. ..... D21/694
6,582,345 B2 * 6/2003 Roy ..... 482/98

* cited by examiner

*Primary Examiner*—Jerome Donnelly

(57) ABSTRACT

A combination stack weight selector and add-on assembly for selecting the stack of weights to be lifted and also supporting any add-on weights for the user of a weight-lifting machine. The combination stack weight selector and add-on assembly includes a selector/support member having a handle member and an elongate shaft member being securely attached to the handle member for selection of weights to be lifted on an exercise machine; and also includes a weight member being supported upon the selector/support member.

3 Claims, 3 Drawing Sheets

COMBINATION STACK WEIGHT SELECTOR AND ADD-ON ASSEMBLY

BACKGROUND OF THE INVENTION

1. Field of the Invention

The present invention relates to a combination weight selectors and add-ons and more particularly pertains to a new combination stack weight selector and add-on assembly for selecting the stack of weights to be lifted and also supporting any add-on weights for the user of a weight-lifting machine.

2. Description of the Prior Art

The use of combination weight selectors and add-ons is known in the prior art. More specifically, combination weight selectors and add-ons heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,746,113; U.S. Pat. No. 5,556,362; U.S. Pat. No. 4,971,305; U.S. Pat. No. 5,000,446; U.S. Pat. No. 4,531,728; and U.S. Pat. No. Des. 349,035.

While these devices fulfill their respective, particular objectives and requirements, the aforementioned patents do not disclose a new combination stack weight selector and add-on assembly. The prior art describes inventions having pins which are inserted in holes provided either in the weights or in the support for the weights to select the weights to be lifted.

SUMMARY OF THE INVENTION

The general purpose of the present invention, which will be described subsequently in greater detail, is to provide a new combination stack weight selector and add-on assembly which has many of the advantages of the combination weight selectors and add-ons mentioned heretofore and many novel features that result in a new combination stack weight selector and add-on assembly which is not anticipated, rendered obvious, suggested, or even implied by any of the prior art combination weight selectors and add-ons, either along or in any combination thereof. The present invention includes a selector/support member having a handle member and an elongate shaft member being securely attached to the handle member for selection of weights to be lifted on an exercise machine; and also includes a weight member being supported upon the selector/support member. None of the prior art includes a tool which not only selects the weights to be lifted but also allows the user to add-on weights to be lifted.

There has thus been outlined, rather broadly, the more important features of the combination stack weight selector and add-on assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new combination stack weight selector and add-on assembly which has many of the advantages of the combination weight selectors and add-ons mentioned heretofore and many novel features that result in a new combination stack weight selector and add-on assembly which is not anticipated, rendered obvious, suggested, or even implied by any of the prior art combination weight selectors and add-ons, either alone or in any combination thereof.

Still another object of the present invention is to provide a new combination stack weight selector and add-on assembly for selecting the stack of weights to be lifted and also supporting any add-on weights for the user of a weight-lifting machine.

Still yet another object of the present invention is to provide a new combination stack weight selector and add-on assembly that is easy and convenient to use.

Even still another object of the present invention is to provide a new combination stack weight selector and add-on assembly that allows the users to add weight and to select the stack of weights to be used.

These together with other objects of the invention, along with the various features of novelty which characterize the invention, are pointed out with particularity in the claims annexed to and forming a part of this disclosure. For a better understanding of the invention, its operation advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
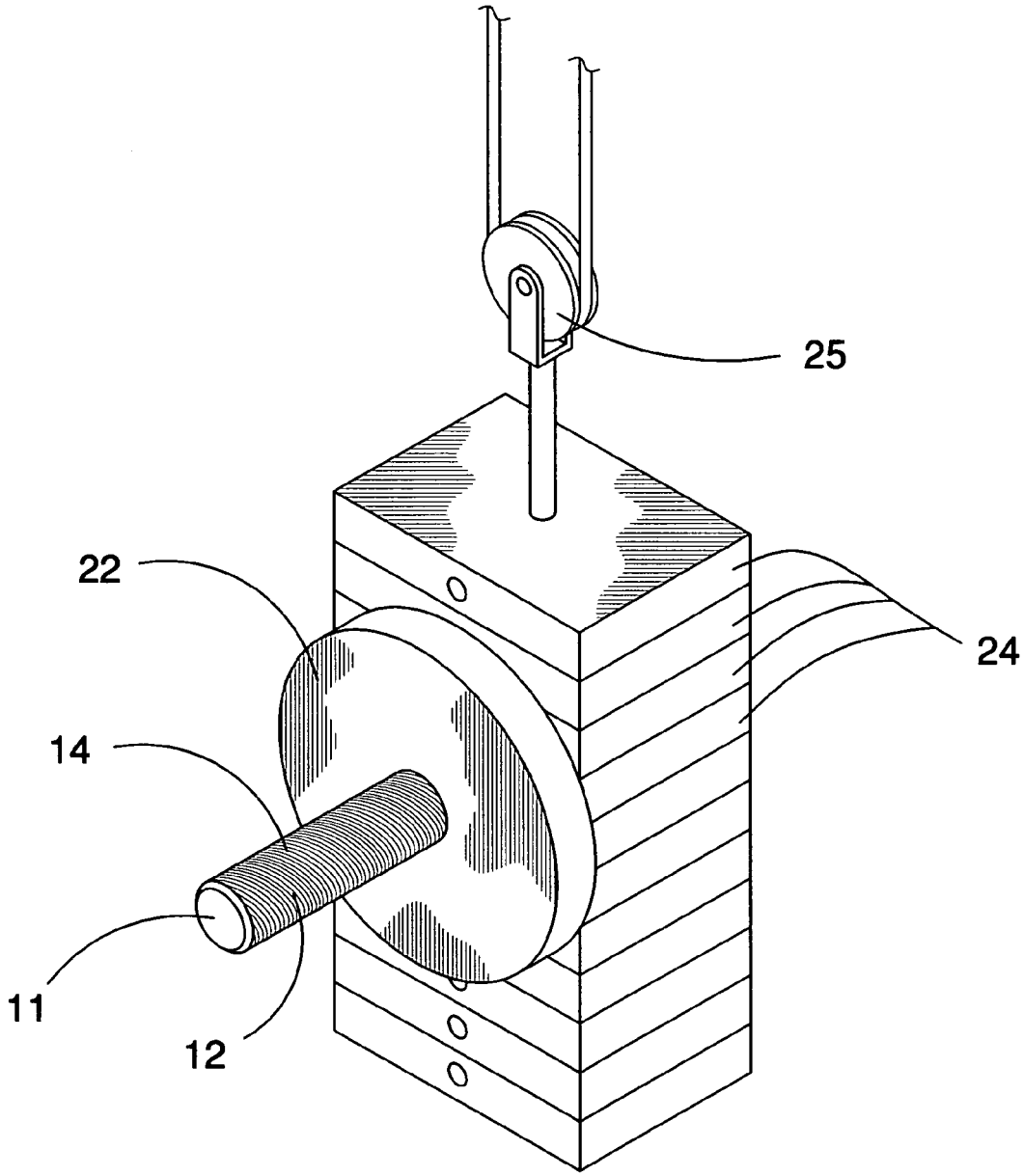
FIG. 1 is a perspective view of a new combination stack weight selector and add-on assembly according to the present invention.
Figure 2:
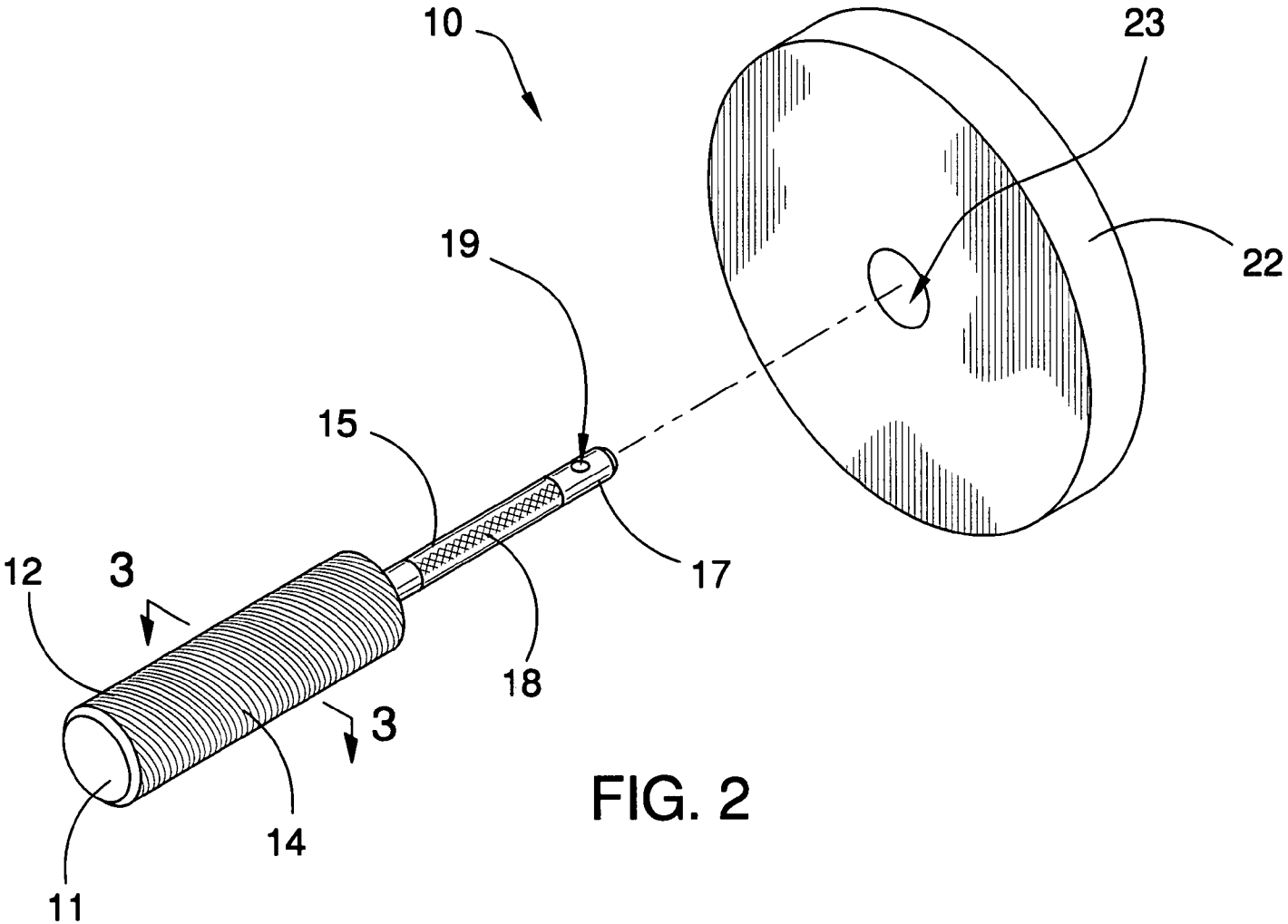
FIG. 2 is an exploded perspective view of the present invention.
Figure 3:
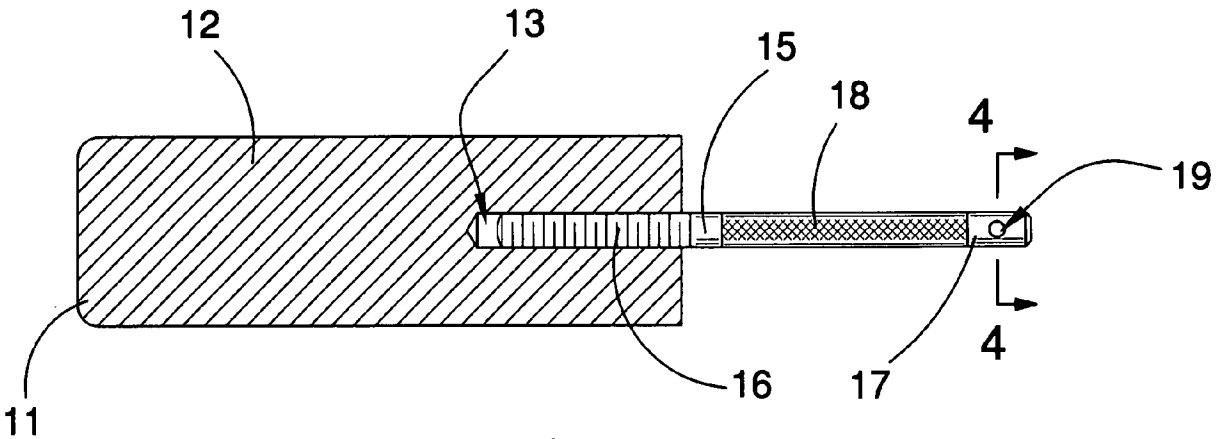
FIG. 3 is a cross-sectional view of the selector/support member of the present invention.
Figure 4:
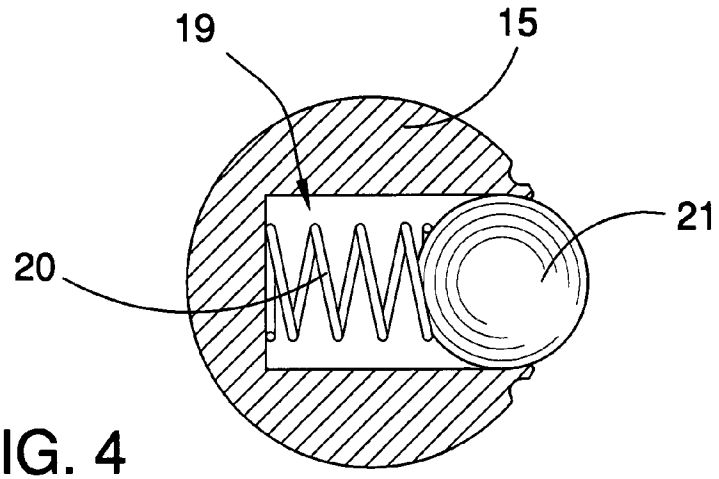
FIG. 4 is a detailed lateral cross-sectional view of the selector/support member of the present invention.

With reference now to the drawings, and in particular to FIGS. 1 through 4 thereof, a new combination stack weight selector and add-on assembly embodying the principles and concepts of the present invention and generally designated by the reference numeral 10 will be described.

As best illustrated in FIGS. 1 through 4, the combination stack weight selector and add-on assembly 10 generally comprises a selector/support member 11 having a handle member 12 and an elongate shaft member 15 being securely and conventionally attached to the handle member 12 for selection of weights 24 to be lifted on a weight-lifting machine 25. The handle member 12 has a bore 13 extending therein through an end thereof, and has a knurled exterior surface 14, and is cylindrical shaped. The elongate shaft member 15 has a first end portions 16 which is threaded into the bore 13 of the handle member 12, and has a second end portion 7 having a laterally-extended slot 19 being disposed therein. The elongate shaft member 15 also has a knurled exterior surface 18 disposed between the first and second end portions 16, 17. The selector/support member 11 also includes a spring member 20 being securely and conventionally disposed in the laterally-extended slot 19, and includes a ball member 21 being conventionally attached to the spring member 20 and being partially and biasedly exposed from the laterally-extended slot 19 to effectively retain the second end portion 17 of the elongate shaft member 15 either in a support for the stack of weights or in one of the weights 24 of the stack of weights which are to be lifted by the user.

One or more weight members 22 are supported upon the selector/support member 11. Each weight member 22 has a hole 23 being centrally-disposed therethrough and through which the elongate shaft member 15 is removably extended to support and add-on the weight member 22 to the stack of weights 24 to be lifted by the user. The weight member 22 is disc-shaped, and the hole 23 is disposed along an axis thereof with the weight member 22 being removably securely supported upon the knurled exterior surface 18 of the elongate shaft member 15.

In use, the user mounts one or more weight members 22 upon the elongate shaft member 15 and inserts the elongate shaft member 15 in either a support for the stack of weights or in one of the weights 24 to select the weights 24 the user is gong to lift using the conventional weight-lifting machine 23. All of the weights 24 located above the elongate shaft member 15 will be the weights 24 to be lifted by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the combination stack weight selector and add-on assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination stack weight selector and add-on assembly comprising:

a selector/support member having a handle member and an elongate shaft member being securely attached to said handle member for selection of weights to be lifted on a weight-lifting machine, said handle member having a bore extending therein through an end thereof, and having a knurled exterior surface, and is cylindrical shaped, said elongate shaft member having a first end portion which is threaded into said bore of said handle member, and having a second end portion having a laterally-extended slot being disposed therein, said elongate shaft member also having a knurled exterior surface disposed between said first and second end portions; and one or more weight members being supported upon said selector/support member, said selector/support member also including a spring member being securely disposed in said laterally-extended slot, and including a ball member being attached to said spring member and being partially and biasedly exposed from said slot to effectively retain said second end portion of said elongate shaft member either in a support for the stack of weights or in one of the weights of the stack of weights which are to be lifted by the user.

2. A combination stack weight selector and add-on assembly as described in claim 1, wherein each said weight member has a hole being centrally-disposed therethrough and through which said elongate shaft member is removably extended to support and add-on said weight member to the stack of weights to be lifted by the user.

3. A combination stack weight selector and add-on assembly as described in claim 2, wherein said weight member is disc-shaped, and said hole is disposed along an axis thereof, said weight member being removably securely supported upon said knurled exterior surface of said elongate shaft member.

* * * * *